United States Patent [19]

Burchett et al.

[11] 4,359,960

[45] Nov. 23, 1982

[54] MARINE TETHER ANCHORING DEVICE

[75] Inventors: Clive J. Burchett, Woodlands; Nigel J. Bryant, Fareham, both of England

[73] Assignee: Vickers Limited, London, England

[21] Appl. No.: 227,013

[22] Filed: Jan. 21, 1981

[30] Foreign Application Priority Data

Jan. 30, 1980 [GB] United Kingdom ..... 8003108
Sep. 15, 1980 [GB] United Kingdom ..... 8029947

[51] Int. Cl.[3] ..... B63B 21/26; F16B 13/06
[52] U.S. Cl. ..... 114/294; 403/297
[58] Field of Search ..... 114/293, 294, 264, 265, 114/230; 403/290, 297; 279/43, 50, 2 A, 2 R; 294/94, 89; 405/224

[56] References Cited

U.S. PATENT DOCUMENTS 2,548,096 4/1951 Bryant et al. ..... 279/2 A
3,638,988 2/1972 Brown ..... 294/86.18
4,132,147 1/1979 Contaldo ..... 403/290

FOREIGN PATENT DOCUMENTS 1348836 12/1964 France ..... 279/2
1340543 12/1973 United Kingdom ..... 114/264
2010431 6/1979 United Kingdom .

*Primary Examiner*—Trygve M. Blix
*Assistant Examiner*—Thomas J. Brahan
*Attorney, Agent, or Firm*—Pollock, Vande Sande & Priddy

[57] ABSTRACT

A releasable marine tether connection comprises a tether having a segmented spring collet which can be expanded to become trapped in an anchor chamber. A spigot is provided in the base of the chamber which urges the plug upwards relative to the collet when the tether is pushed into the chamber to make the connection. To release the connection tension is removed from the tether and the plug moved down to allow the spring collet to close and move out of the chamber.

2 Claims, 4 Drawing Figures

MARINE TETHER ANCHORING DEVICE

BACKGROUND OF THE INVENTION

The invention relates to marine tether anchoring devices.

Various methods are known for fixing tethers of drilling platforms, and the like, in position and it is an object of the present invention to provide an improved marine tether anchoring device which can be released and re-established if necessary and as required.

SUMMARY OF THE INVENTION

According to the invention, there is provided a marine tether anchoring device for use with an anchoring chamber comprising a hollow segmented spring collet having adjacent its extreme end an inner enlarged cavity, an intermediate section of diminishing width between said cavity and a hollow passage through said collet, a locking plug extending along said hollow passage and having an end of increased width arranged to be located in said enlarged cavity in a first position, and means for moving said plug between said first position and a second position when said plug engages the intermediate section to open out the collet and provide a securing of the collet in the anchoring chamber.

Marine tether anchoring devices according to the invention will now be described.

DESCRIPTION OF THE PREFERRED EMBODIMENT

Figure 1:
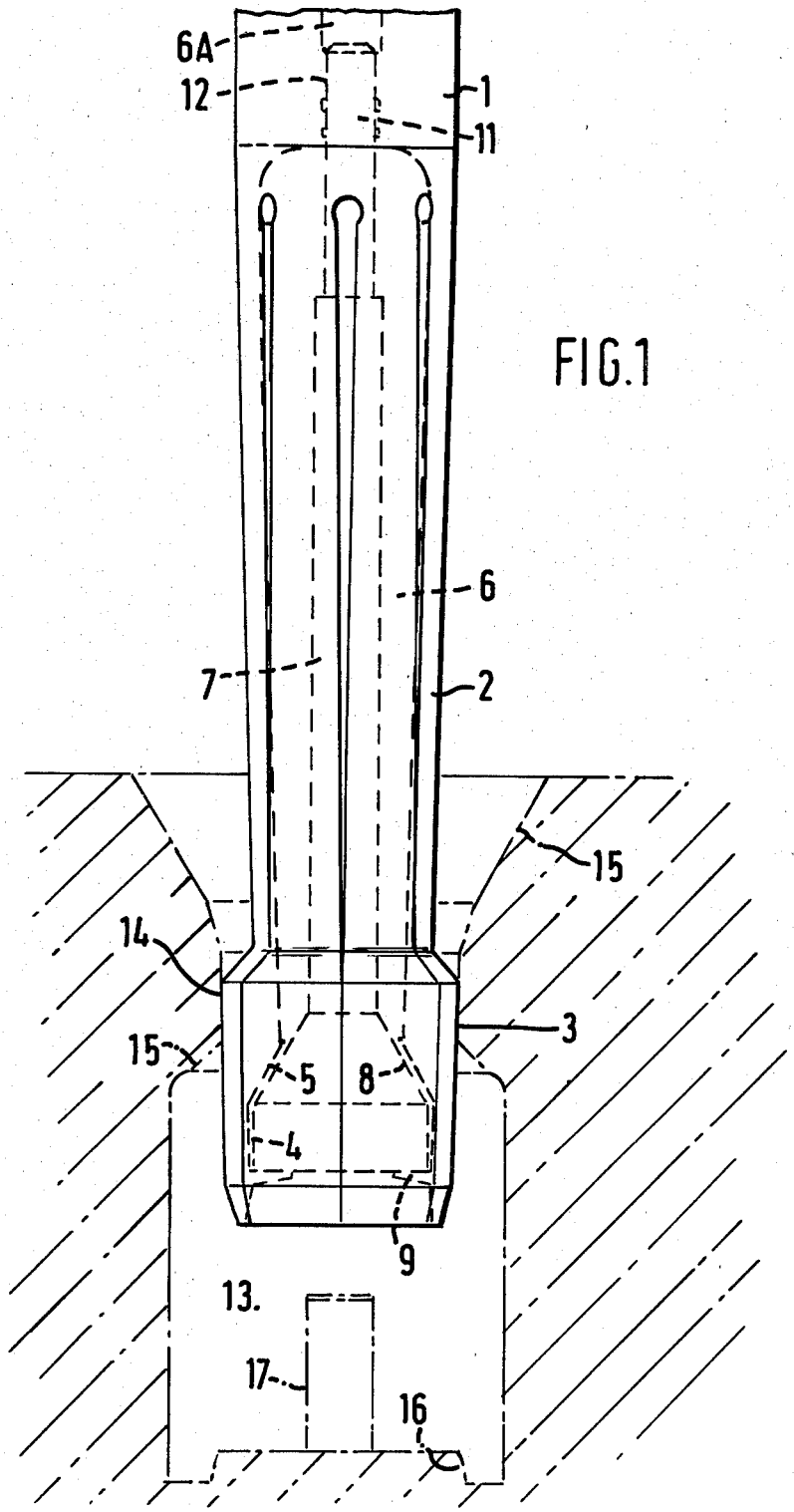
FIG. 1 shows the anchoring device partially entered into an anchoring chamber.

Referring to the drawings, a marine tether 1 is provided with a hollow segmented spring collet 2 which extends from the tether 1 with its outer surface adjacent its extreme end extending outwardly at 3 and to provide within the collet 2 an enlarged cavity 4. An intermediate section 5 between the cavity 4 and a hollow passage 6 of the collet is of frustoconical shape. A locking plug 7 (shown in FIG. 1 in a lowermost or first position in the cavity 4) has a frustoconical portion 8 which fits snugly in the section 5.

A flange 9 at the extreme end of the collet 2 is provided to prevent the locking plug 7 moving out of the collet beyond its first position. A lip 10 (better seen in FIGS. 2 and 3) is provided to resist movement of the plug 7 from a second position, shown in FIGS. 2 and 3, towards the first position. The locking plug 7 is provided with a piston 11 which is entered in a cylinder 12 formed in a hollow passage 6A of the collet extending beyond the locking plug.

The anchoring chamber comprises a chamber portion 13, a neck portion 14 and frustoconical portion 15 between the chamber portion 13 and the neck portion 14. Extending beyond the neck portion 14 there is provided an entry cone 15A. The floor of the chamber is provided with a conical seating 16 and a spigot 17.

Figure 2:
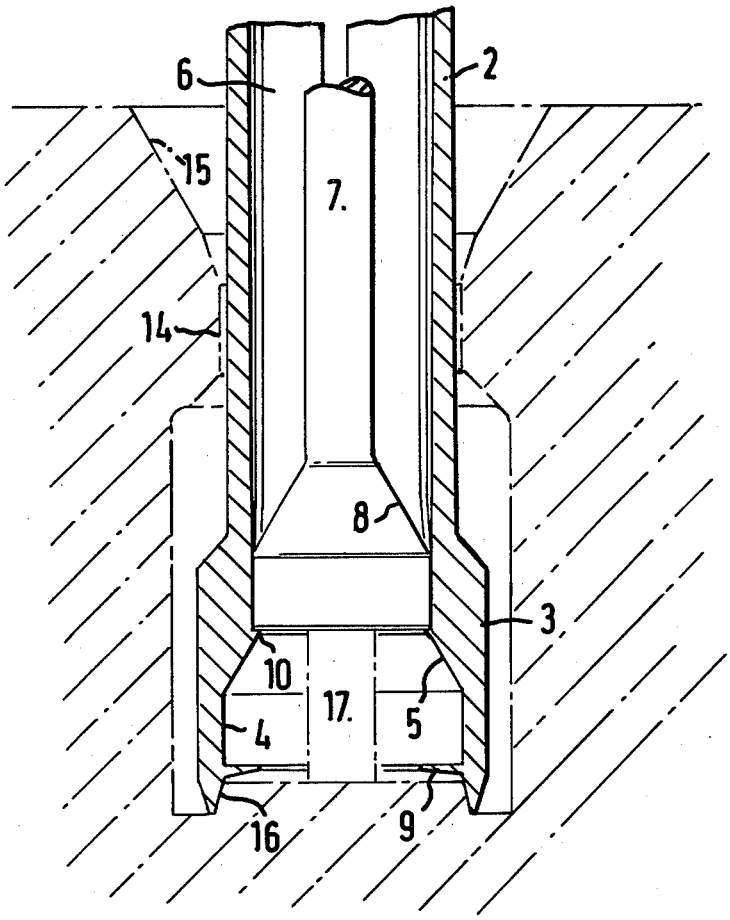
FIGS. 2 and 3 show in section the anchoring device in different relative positions with respect to the chamber.
Figure 3:
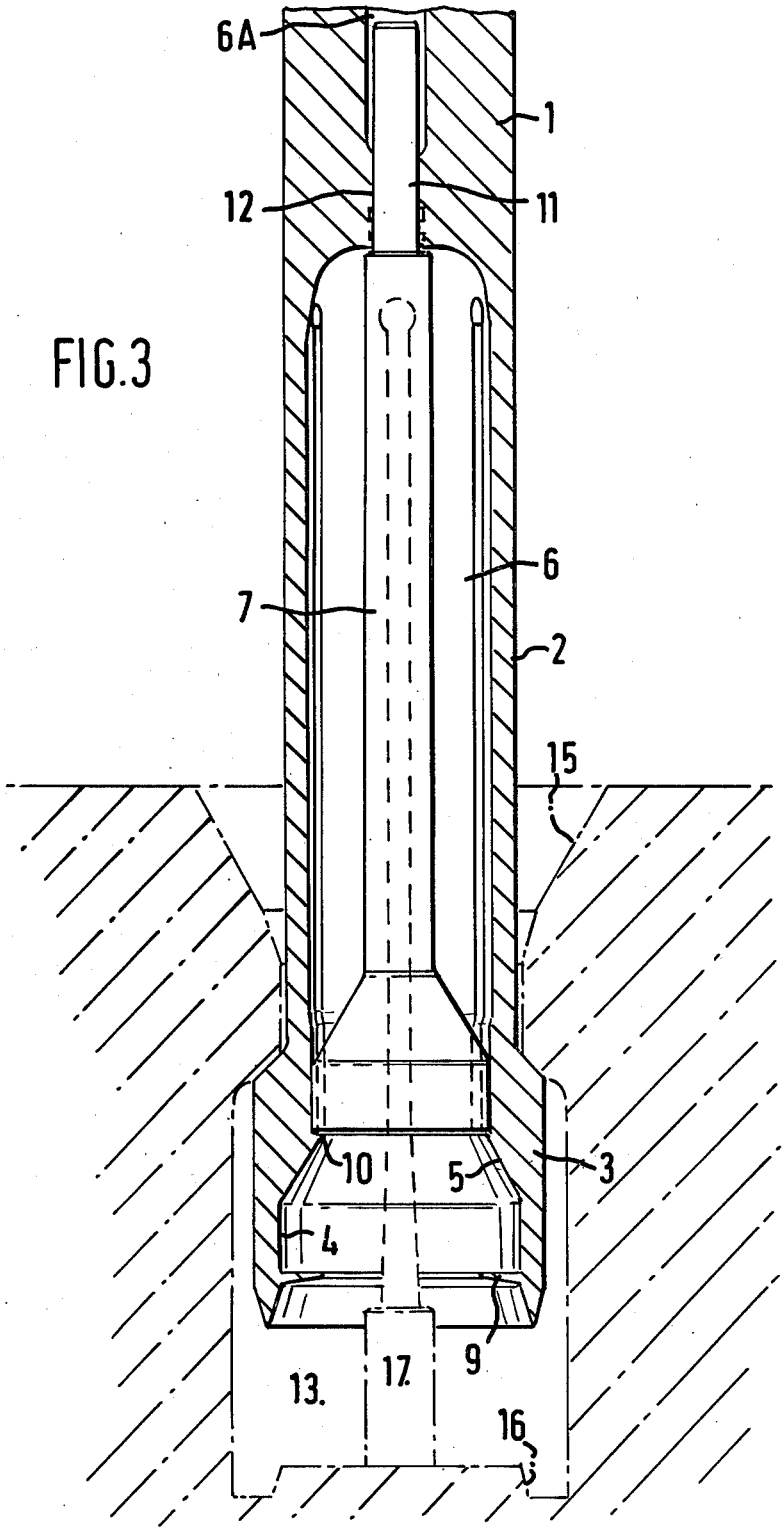

In use, the collet 2 is guided by the cone 15A through the neck portion 14 towards the chamber 13 (FIG. 1). The collet 2 may be compressed to some extent during passage through the neck and it will be noted that the lower edge of the collet 2 is chamfered to help guide the collet 2 into the neck portion 14. The collet 2 is pushed down into the chamber until the spigot 17 engages the end surface of the locking plug 7 and urges it from its first position to its second position (FIG. 2). The locking plug 7 in its second position bears against the surface of the passage 6 and causes the collet to open out. The securing position is shown in FIG. 3 with tension applied to the tether 1 so that the outwardly extending part 3 of the collet 2 is trapped in the anchoring chamber.

In order to release the anchoring device, tension must be removed from the tether and the collet allowed to move towards the floor of the chamber 13. The seating 16 then engages the end of the collet and opens out the collet 2 a little further so that the lips 10 allow locking plug 7 to move under hydraulic pressure applied to the piston 11, towards the floor of the cavity 13 and to its first position. The collet 2 springs back to its closed position and can then be withdrawn through the neck 14 to release the tether 1 from the anchoring chamber.

In the described embodiment, the plug 7 is moved by the spigot 17 from its first to its second position. It will be appreciated that hydraulic, pneumatic or mechanical operative means may be arranged to move the plug 7 from the first to the second position in the absence of a spigot 17 being provided. In the same way, the lip 10 provided in the described arrangement may be dispensed with where plug operative means are provided which locate the plug securely in the second position. Likewise, the flange 9 can be dispensed with if the operative means is arranged to prevent the plug 7 moving beyond said first position.

In another embodiment, the plug 7 is provided with mechanically operative means which in one arrangement comprises a rack mounted on the plug instead of the piston 11 and a pivoted toothed lever mounted on the collet 2 to engage the rack and move the plug between the first and second positions as required.

It will be noted that a marine tether anchoring device according to the invention may for example comprise a collet having a cavity which is generally tapered to narrow from the extreme end of the collet. The plug is arranged to have a tapered end arranged to fit inside the cavity. In its first position the plug 7 is dimensioned and arranged generally as described earlier so that it does not expand the end of the collet. The plug 7 can be moved to its second position and as it moves its outer tapered surface engages the inner tapered surface of the collet cavity to expand the end of the collet. Such an anchoring device can be used with the chamber 13 shown in FIGS. 1 to 3 or if preferred the anchoring device can be used with a generally taper-shaped anchoring chamber. Once the anchoring device is entered fully into a tapered anchoring chamber the plug can be moved from its first position towards its second position until the collet jams in the chamber to form a secure interconnection between the collet and the chamber.

In all embodiments of the invention it will be noted that anchoring devices which are releasable are provided. This means that a drilling platform, for example, can be firmly tethered to anchoring points and readily released as required from time to time and later re-secured as desired.

Figure 4:
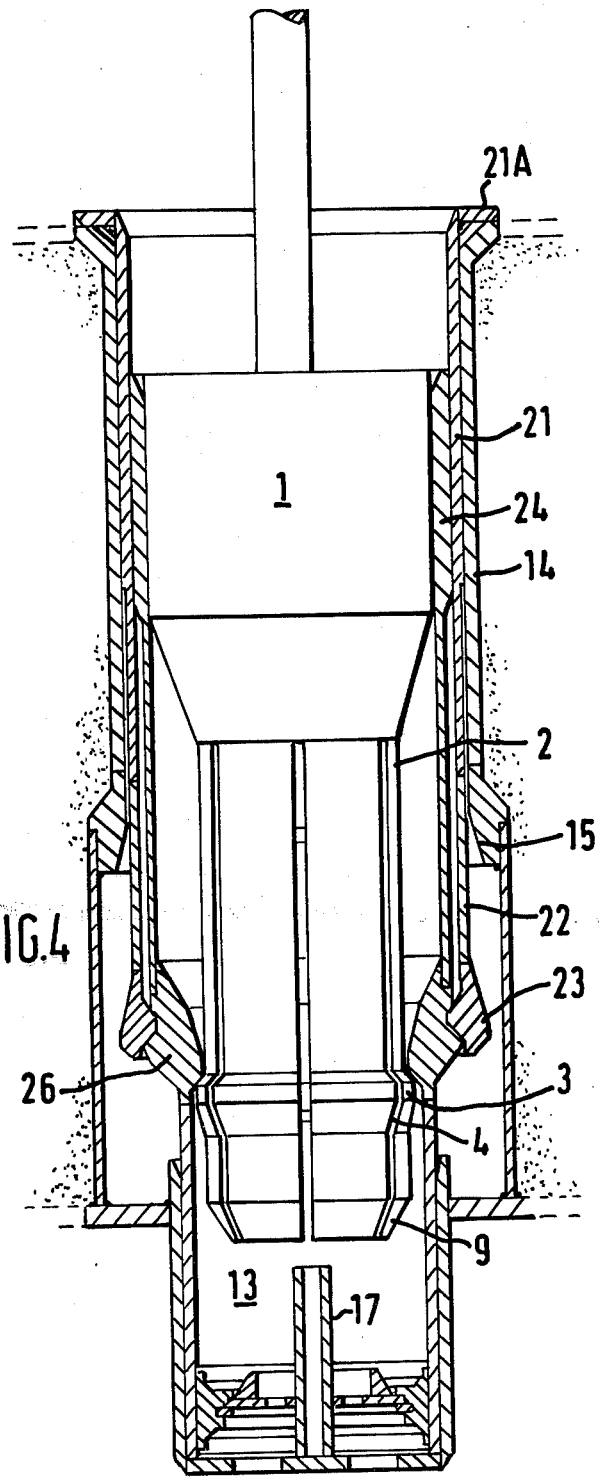
FIG.4 shows in section a modified arrangement.

In FIG. 4, like numerals are used for like parts of FIGS. 1 to 3. The neck 14 of the chamber 13 is provided with a slidable sleeve 21 extending to a spring collet 22 at its lower end provided with a load ring 23. A second sleeve 24 fits snugly and slidably in the sleeve 21 and surrounds a tether connector 1 at its upper end and carries an intermediate locking ring 26 for engaging the load ring 23 and an outward extending part 3 of the collet 2 of the connector 1. The spigot 17 is supported and fixed to the lower end of the sleeve 24.

In use, the sleeve 21 is inserted into the neck 14 of the chamber, a flange 21A at its upper end limiting downward movement. The sleeve 24 is then slid down into the position shown in FIG. 4. The connector 1 is then lowered into the chamber until the plug 7 (shown in FIGS. 1 to 3) is urged upwardly to expand the spring collet 2. The connector is then raised to the position shown in FIG. 4 where the locking ring 26 engages the part 3. Further upward movement, as tension is applied to the tether, forces both the sleeves 21 and 24 upwards until the load ring 23 engages the portion 15 of the neck 14. The connector is then in its fully locked position.

To release the connector, tension is removed from the tether and the plug 7 lowered (as described with reference to FIGS. 1 to 3) allowing the connector 1 to be withdrawn. In the event this action fails to release the connector, the sleeve 21 is forcibly pushed down (to the position shown in FIG. 4) and held down (by means not shown) and tension then applied to the tether to draw out the connector, together with the sleeve 24, forcing open the collet 22.

The embodiment of FIG. 4, thus provides a secondary release procedure if the primary procedure fails.

It will be noted that various interacting frustoconical shaped surfaces are described. In one or more cases such surfaces may be, for example, generally part-circular in cross-section and/or formed as annuli attached to the lower parts of the plug 7, the spring collet 2 and so on as required to provide the releasable interaction of the various surfaces as described.

We claim:

1. A marine tether anchoring device for use with an anchoring chamber having a neck portion, comprising a tether provided with a hollow segmented first spring collet adapted to be inserted into the neck portion of said chamber, said first collet having adjacent its extreme end an inner enlarged cavity, an intermediate section of diminishing width between said cavity and a hollow passage through said first collet, a locking plug extending along said hollow passage and having an end of increased width arranged to be located in said enlarged cavity in a first position, and means for moving said plug between said first position and a second position when said plug engages the intermediate section to open out said first collet and provide a securing of said first collet in the anchoring chamber, said anchoring device further comprising a first slideable sleeve in the neck portion of the anchoring chamber, said first sleeve having a second spring collet, provided with a load ring at its lower end, and which can be expanded to be securely engaged in an uppermost position in said anchoring chamber when tension is applied to the tether, and a second slideable sleeve within said first sleeve and surrounding said hollow segmented first spring collet, said second sleeve extending to a locking ring arranged to engage between said load ring and outer parts of said intermediate section, in which said load ring can be forced outwards to release said locking ring when said first slideable sleeve is in a lowermost position.

2. A marine tether anchoring device according to claim 1, in which said means for moving said plug between said first and second positions comprises a spigot, said second sleeve extending beyond said locking ring to support and locate said spigot so that it is arranged to move the locking plug from said first position to said second position when the anchoring device is pressed towards the bottom of the anchoring chamber.

* * * * *